US006980193B2

(12) United States Patent
Hoshino

(10) Patent No.: US 6,980,193 B2
(45) Date of Patent: Dec. 27, 2005

(54) GRAY SCALE DRIVING METHOD OF LIQUID CRYSTAL DISPLAY PANEL

(75) Inventor: Masafumi Hoshino, Chiba (JP)

(73) Assignee: Seiko Instruments Inc., Chiba (JP)

( * ) Notice: Subject to any disclaimer, the term of this patent is extended or adjusted under 35 U.S.C. 154(b) by 393 days.

(21) Appl. No.: 10/245,414

(22) Filed: Sep. 17, 2002

(65) Prior Publication Data

US 2003/0117351 A1 Jun. 26, 2003

(30) Foreign Application Priority Data

Dec. 20, 2001 (JP) ..... 2001-387307

(51) Int. Cl.[7] ..... G09G 3/36
(52) U.S. Cl. ..... 345/99; 345/94; 345/691
(58) Field of Search ..... 345/87, 89, 94, 345/99, 98, 204, 690, 691, 692

(56) References Cited

U.S. PATENT DOCUMENTS

| | | | | |
|---|---|---|---|---|
| 5,619,228 | A * | 4/1997 | Doherty | 345/693 |
| 5,821,910 | A * | 10/1998 | Shay | 345/99 |
| 6,215,469 | B1 * | 4/2001 | Mori et al. | 345/691 |
| 6,377,234 | B1 * | 4/2002 | Nogawa | 345/89 |
| 6,753,838 | B2 * | 6/2004 | Kuijk et al. | 345/89 |
| 6,850,251 | B1 * | 2/2005 | Yasunishi et al. | 345/693 |

* cited by examiner

*Primary Examiner*—Kent Chang
(74) *Attorney, Agent, or Firm*—Adams & Wilks

(57) ABSTRACT

There is provided a simple matrix liquid crystal panel in which the number of changes in waveform on a column electrode is suppressed without degrading a display quality even when the number of gray scales is increased, and a consumption power can be reduced. Pulse width modulation is performed with a sum total of a plurality of pulses selected in a plurality of frames, and the number of changes in column electrode for displaying a half tone pixel data on a pixel is set as 1 during the plurality of frames. Further, an occurrence order of dividing frames in an odd row is made different from that in an even row and interlaced scanning is conducted. Thus, the consumption power is greatly reduced as compared with the case of conventional pulse width modulation.

4 Claims, 8 Drawing Sheets

FIG.3

FRAME

| GRAY SCALE LEVEL | ROW / COLUMN | 1 | | 2 | | 3 | | 4 | |
|---|---|---|---|---|---|---|---|---|---|
| | | ODD | EVEN | ODD | EVEN | ODD | EVEN | ODD | EVEN |
| 0 | 2n+1 | 0 | 0 | 0 | 0 | 0 | 0 | 0 | 0 |
| | 2n+2 | 0 | 0 | 0 | 0 | 0 | 0 | 0 | 0 |
| 1 | 2n+1 | 1 | 0 | 0 | 1 | 0 | 0 | 0 | 0 |
| | 2n+2 | 0 | 0 | 0 | 0 | 1 | 0 | 0 | 1 |
| 2 | 2n+1 | 1 | 0 | 0 | 1 | 1 | 0 | 1 | 0 |
| | 2n+2 | 0 | 1 | 1 | 0 | 0 | 1 | 0 | 1 |
| 3 | 2n+1 | 0 | 1 | 1 | 0 | 1 | 1 | 1 | 1 |
| | 2n+2 | 1 | 1 | 1 | 1 | 0 | 1 | 1 | 0 |
| 4 | 2n+1 | 1 | 1 | 1 | 1 | 1 | 1 | 1 | 1 |
| | 2n+2 | 1 | 1 | 1 | 1 | 1 | 1 | 1 | 1 |

FRAME MODULATION PATTERN (5 GRAY SCALES)

N-ROW PANEL n: 0 - N/2

WHEN BOTH ADJACENT ROW ELECTRODES ARE ON OR OFF

WHEN ONE OF ADJACENT ROW ELECTRODES IS ON AND THE OTHER IS OFF

WAVEFORM IN DRIVE USING VOLTAGE AVERAGING METHOD OR SA METHOD (DIAGONALLY SHADED AREA INDICATING COLUMN ELECTRODE WAVEFORM) (CONVENTIONAL EXAMPLE)

FIG.5

4-FRAME PULSE WIDTH MODULATION PATTERN

| FRAME | | a | | | | b | | | | c | | | | d | | | |
|---|---|---|---|---|---|---|---|---|---|---|---|---|---|---|---|---|---|
| PULSE WIDTH | | 0 | 1 | 2 | 3 | 0 | 1 | 2 | 3 | 0 | 1 | 2 | 3 | 0 | 1 | 2 | 3 |
| GRAY SCALE LEVEL | 0 | 0 | 0 | 0 | 0 | 0 | 0 | 0 | 0 | 0 | 0 | 0 | 0 | 0 | 0 | 0 | 0 |
| | 1 | 1 | 1 | 1 | 1 | 0 | 0 | 0 | 0 | 0 | 0 | 0 | 0 | 0 | 0 | 0 | 0 |
| | 2 | 1 | 1 | 1 | 1 | 1 | 1 | 0 | 0 | 0 | 0 | 0 | 0 | 0 | 0 | 0 | 0 |
| | 3 | 1 | 1 | 1 | 1 | 1 | 1 | 1 | 1 | 0 | 0 | 0 | 0 | 0 | 0 | 0 | 0 |
| | 4 | 1 | 1 | 1 | 1 | 1 | 1 | 1 | 1 | 1 | 0 | 0 | 0 | 0 | 0 | 0 | 0 |
| | 5 | 1 | 1 | 1 | 1 | 1 | 1 | 1 | 1 | 1 | 1 | 1 | 0 | 0 | 0 | 0 | 0 |
| | 6 | 1 | 1 | 1 | 1 | 1 | 1 | 1 | 1 | 1 | 1 | 1 | 1 | 1 | 0 | 0 | 0 |
| | 7 | 1 | 1 | 1 | 1 | 1 | 1 | 1 | 1 | 1 | 1 | 1 | 1 | 1 | 1 | 1 | 1 |

FIG.6

FRAME 0

| | ODD COLUMN | EVEN COLUMN |
|---|---|---|
| ODD ROW | a | b |
| EVEN ROW | c | d |

FRAME 1

| | ODD COLUMN | EVEN COLUMN |
|---|---|---|
| ODD ROW | c | d |
| EVEN ROW | a | b |

FRAME 2

| | ODD COLUMN | EVEN COLUMN |
|---|---|---|
| ODD ROW | b | a |
| EVEN ROW | d | c |

FRAME 3

| | ODD COLUMN | EVEN COLUMN |
|---|---|---|
| ODD ROW | d | c |
| EVEN ROW | b | a |

OCCURRENCE PATTERN OF 4-FRAME PULSE WIDTH MODULATION PATTERN ON SCREEN

ODD COLUMN

EVEN COLUMN

COLUMN ELECTRODE WAVEFORM BY VOLTAGE AVERAGING METHOD OR SA METHOD OF THE PRESENT INVENTION

FIG.8

| | | | | |
|---|---|---|---|---|
| 1 | +1 | -1 | -1 | -1 |
| 2 | -1 | +1 | -1 | -1 |
| 3 | -1 | -1 | +1 | -1 |
| 4 | -1 | -1 | -1 | +1 |

ORTHOGONAL FUNCTION (4MLA)

FIG.9A

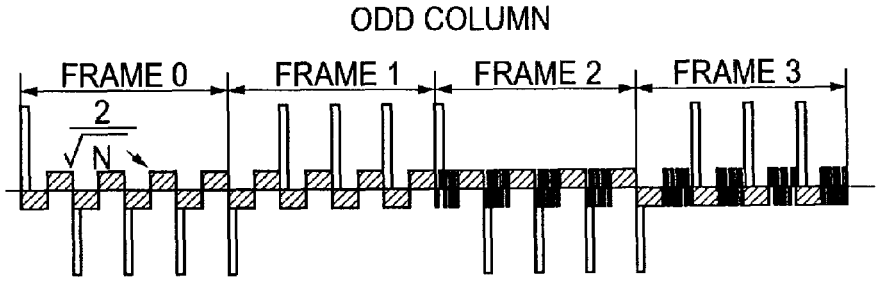

COLUMN ELECTRODE WAVEFORM BY DISTRIBUTED 4 MLA METHOD OF THE PRESENT INVENTION

FIG.9B

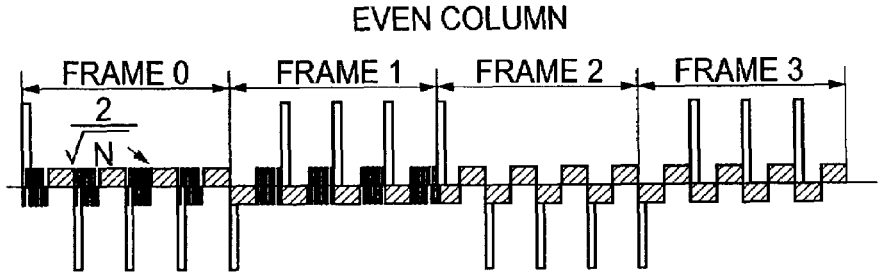

COLUMN ELECTRODE WAVEFORM BY DISTRIBUTED 4 MLA METHOD OF THE PRESENT INVENTION

FIG.10

| | FRAME 0 | | FRAME 1 | | FRAME 2 | | FRAME 3 | |
|---|---|---|---|---|---|---|---|---|
| | ODD COLUMN | EVEN COLUMN | ODD COLUMN | EVEN COLUMN | ODD COLUMN | EVEN COLUMN | ODD COLUMN | EVEN COLUMN |
| FIRST ROW | a | b | c | d | b | a | d | c |
| SECOND ROW | a | b | c | d | b | a | d | c |
| THIRD ROW | c | d | a | b | d | c | b | a |
| FOURTH ROW | c | d | a | b | d | c | b | a |

OCCURRENCE PATTERN OF 4-FRAME PULSE WIDTH MODULATION PATTERN FOR EVERY TWO ROWS ON SCREEN

GRAY SCALE DRIVING METHOD OF LIQUID CRYSTAL DISPLAY PANEL

BACKGROUND OF THE INVENTION

1. Field of the Invention

The present invention relates to a method of driving a simple matrix liquid crystal display panel using an STN liquid crystal or the like, and more particularly to a driving method for a liquid crystal display panel, which is suitable for half tone display by frame modulation and pulse width modulation, and is capable of driving with a low consumption power.

2. Description of the Prior Art

A simple matrix liquid crystal display panel is constructed by holding a liquid crystal layer between a row electrode group and a column electrode group to provide pixels arranged in matrix. As a method of driving the simple matrix liquid crystal display panel, there are exemplified a voltage averaging method, an SA method, an MLA method, and the like.

The voltage averaging method is a method of driving a simple matrix liquid crystal display panel, in which the respective row electrodes are sequentially selected one by one and a data signal corresponding to ON/OFF is provided to all the column electrodes in response to a selected timing. Thus, a voltage applied to each pixel becomes an applied voltage, which is high by one time per frame period T for which all the row electrodes are selected and becomes a predetermined bias voltage during a remaining non-selection time. According to the voltage averaging method, when a response speed of a liquid crystal material to be used is low, a change in brightness corresponding to an effective value of an applied voltage waveform during one frame period is obtained so that a suitable contrast is kept in practical use. However, when the number of divisions is increased, thereby being reduced in a frame frequency, a difference between one frame period and a response time of a liquid crystal becomes small, with the result that the liquid crystal provides a response every time a pulse is applied thereto. Accordingly, a brightness flicker, which is called a frame response phenomenon, is caused, resulting in degradation in a contrast.

The SA method is a method, which is called a smart addressing method, for driving a simple matrix liquid crystal display panel. In either of the voltage averaging method and the SA method, the respective row electrodes are sequentially selected one by one, and a data signal corresponding to ON/OFF is applied to all the column electrodes in response to selected timing. However, non-selection levels of common in adjacent frames are different from each other in the former and are identical in the latter.

The MLA method is also called a plural line simultaneous selection method. By simultaneously selecting a plurality of row electrodes, thereby increasing an apparent frequency and suppressing a frame response phenomenon which causes a problem in the voltage averaging method. In order to independently display each pixel while the plurality of row electrodes are simultaneously selected, a unique idea is employed for the MLA method. According to the idea, a set sequential scanning for applying a plurality of row signals represented by a set of orthogonal functions to a row electrode group in set sequence at every selection time, and a sum-of-products calculation between the set of orthogonal functions and a selected pixel data is sequentially conducted, and a column signal having a voltage level corresponding to the result is applied to a column electrode group during the selection time in synchronization with the set sequential scanning.

Note that the MLA method is disclosed in JP 05-100642 A, JP 06-027907 A, JP 07-072454 A, JP 07-193679 A, JP 07-199863 A, JP 07-311564 A, JP 08-184807 A, JP 08-184808, JP 2000-019482, and the like.

Next, a multi gray scale display method of the simple matrix liquid crystal display panel generally includes a pulse width modulation method and a frame modulation method. In the former, a waveform of a column electrode waveform is switched from ON to OFF in accordance with gray scale information within a period of a selected pulse, with the result that a frequency rises and the consumption power increases. The latter is technically established as a low-cost method. The frame modulation method is a method of selectively turning ON/OFF two gray scales of ON/OFF over a plurality of frames so that a time average value is utilized to provide two or more gray scales. Half tone display of the simple matrix liquid crystal display panel is realized by a combination of a driving method and a multi gray scale display method.

Here, examination is made on a consumption power of the simple matrix liquid crystal display panel as in the case where the pulse width modulation method is used for the multi gray scale display method and it is driven by the voltage averaging method or the SA method. Assume that the simple matrix liquid crystal display panel has a matrix of N-rows and M-columns.

FIG. 2 shows a column electrode waveform by the pulse width modulation, which is applied to the simple matrix liquid crystal display panel, by using a waveform region with oblique lines. In a middle gray scale level, there are an ON period and an OFF period within one selection time, and a round trip is necessarily made during one selection time. Thus, the column electrode waveform is changed two times. Accordingly, the number of changes in column electrode waveform per frame is 2N.

Then, examination will be made of a consumption power of the simple matrix liquid crystal display panel as in the case where the frame modulation method is employed for the multi gray scale display method, and it is driven by the voltage averaging method or the SA method. Note that the frame modulation method is conducted for every row or every pixel.

FIG. 3 shows an example of a 5-gray-scale frame modulation pattern, which is applied to the simple matrix liquid crystal display panel. In FIG. 3, when a gray scale level is 0, with respect to a first frame to a fourth frame, all values at intersections between the rows and the columns in the simple matrix liquid crystal display panel are indicated by 0 (OFF).

When a gray scale level is 1, 1 (ON) is provided to a pixel at an intersection between a (2n+1)the row and an odd column of the first frame of the simple matrix liquid crystal display panel; a pixel at an intersection between a (2n+1)the row and an even column of the second frame; a pixel at an intersection between a (2n+2)the row and an odd column of the third frame; and a pixel at an intersection between a (2n+2)the row and an even column of the fourth frame; and 0 (OFF) is provided to other pixels. In this case, n is an integer from 0 to N/2. Thus, the (2n+1)the row indicates an odd row and the (2n+2)the row indicates an adjacent even row.

When a gray scale level is 2, 1 (ON) is provided to a pixel at an intersection between the (2n+1)the row and the odd column of the first frame of the simple matrix liquid crystal display panel; a pixel at an intersection between the (2n+2) the row and an even column of the first frame; a pixel at an intersection between the (2n+1)the row and the even column of the second frame; a pixel at an intersection between the (2n+1)the row and the odd column of the third frame; the (2n+2)the row and an even column of the third frame; a pixel at an intersection between the (2n+1)the row and an odd column of the fourth frame; and a pixel at an intersection between the (2n+2)the row and the even column of the fourth frame; and 0 (OFF) is provided to other pixels.

When a gray scale level is 3, 0 (OFF) is provided to a pixel at an intersection between the (2n+1)the row and the odd column of the first frame of the simple matrix liquid crystal display panel; a pixel at an intersection between the (2n+1)the row and the even column of the second frame; a pixel at an intersection between the (2n+2)the row and the odd column of the third frame; and a pixel at an intersection between the (2n+2)the row and the even column of the fourth frame; and 1 (ON) is provided to other pixels.

When a gray scale level is 4, with respect to the first frame to the fourth frame, 1 (ON) is provided to all the pixels at intersections between the rows and the columns in the simple matrix liquid crystal display panel.

First, when the frame modulation method based on the 5-gray-scale frame modulation pattern shown in FIG. 3 is applied to the simple matrix liquid crystal display panel driven by the voltage averaging method or the SA method, to thereby conduct the multi gray scale display, the column electrode waveform in the case where an image region is scanned from the top to bottom becomes a waveform as shown in FIG. 4A or 4B. Note that, for simple description, assume that a displayed data is a data of one half tone color.

In other words, FIG. 4A shows a column electrode waveform in the case where both a pixel at an intersection between a column electrode and the (2n+1)the row electrode and a pixel at an intersection between the column electrode and the (2n+2)the row electrode are ON or OFF in the 5-gray-scale frame modulation pattern shown in FIG. 3, by using a waveform region with oblique lines. The level of the column electrode waveform in this case is $+1/\sqrt{N}$ during a selection time t of one frame period T and $-1/\sqrt{N}$ during a remaining non-selection time (T−t). In a next frame, the level is inverted and the similar column electrode waveform is indicated. Thus, when both upper and lower rows are turned ON or OFF in a middle gray scale level, the number of changes in column electrode waveform during one frame period is 1.

Also, FIG. 4B shows a column electrode waveform in the case where one of a pixel at an intersection between a column electrode and the (2n+1)the row electrode and a pixel at an intersection between the column electrode and the (2n+2)the row electrode is ON and the other is OFF in the 5-gray-scale frame modulation pattern shown in FIG. 3, by using a waveform region with oblique lines. The level of the column electrode waveform in this case is $+1/\sqrt{N}$ during the selection time t of one frame period T. With respect to the remaining non-selection time (T−t), a level is $-1/\sqrt{N}$ during a first t and $+1/\sqrt{N}$ during a next t. Hereinafter, a level is similarly changed up to a final t. In a next frame, the level is inverted and the similar column electrode waveform is indicated. Thus, when rows are turned ON or OFF every two rows in the middle gray scale level, the number of changes in column electrode waveform during one frame period is N, which is equal to the number of row electrodes.

Incidentally, the consumption power of the liquid crystal panel is determined by a free discharge current between the row electrode and the column electrode. In other words, the consumption power of the liquid crystal panel is determined by a voltage value and its waveform (the amount of change) between the row electrode and the column electrode.

Therefore, in the simple matrix liquid crystal panel for performing multi gray scale display, the number of changes in column electrode waveform in the pulse width modulation method becomes larger than that in the frame modulation method, and the consumption power is also increased in proportion to the number of changes. However, in the case of the frame modulation method, the number of frames for representing gray scales is increased with increasing the number of gray scales. Thus, a flicker, roughness, or the like is caused on a screen, thereby deteriorating a display quality.

SUMMARY OF THE INVENTION

The present invention has been made to solve the above-mentioned problems, and it is an object of the invention to provide a method of driving a simple matrix liquid crystal panel, in which changes in waveform on a column electrode is suppressed without deteriorating a display quality even when the number of gray scales is increased, and the consumption power can be reduced.

In order to solve the above-mentioned problems, pulse width modulation is performed using a sum total of a plurality of pulses selected in a plurality of frames, and the number of changes in column electrode for displaying a half tone pixel data on a pixel is set as 1 during the plurality of frames. In addition, attention is directed to the fact that a gray scale level of a background color or of a display data mainly used is not frequently and greatly changed, the present invention is constructed.

In other words, in a liquid crystal display panel driving method of driving a liquid crystal display panel in which a liquid crystal layer is held between a row electrode group and a column electrode group to provide pixels in matrix in accordance with a given image data, one selection time is equally divided into a plurality of periods, the equal division is repeated during periods of several frames, and half tone display is conducted with a sum total of equally divided periods at selection of the respective frames.

Also, the method is characterized in that an occurrence order of the plurality frames in an odd row into which a pattern of the pulse width modulation is divided is different from that in an even row.

Further, in the above liquid crystal display panel driving method, the odd row and the even row are separately scanned. When scanning is conducted for only the odd row, an occurrence order of the plurality frames into which a pattern of the pulse width modulation is divided is the same during the scanning. Thus, the number of changes in a column electrode waveform is minimized. Similarly, in the case of scanning for only the even row, the number of changes in a column electrode waveform is minimized and low consumption power is attained.

Also, the method is characterized in that an occurrence order of the plurality frames into which a plurality of patterns of the pulse width modulation divided are different for every plural columns.

Also, in the liquid crystal display panel driving method, scanning is conducted within the same frame for every row having the same occurrence order of the plurality frames. Only a row having the same occurrence order of the plurality frames is used and scanning is conducted for each row. Thus, the number of changes in column electrode waveform is minimized and low consumption power is attained.

BRIEF DESCRIPTION OF THE DRAWINGS

In the accompanying drawings:

FIG. 3 shows an example of a frame modulation pattern of 5 gray scales;

FIG. 5 shows a 4-frame pulse pattern modulation pattern;

FIG. 6 shows an occurrence pattern of the 4-frame pulse width modulation pattern on a screen;

FIG. 8 shows an example of an orthogonal function table used in a 4 MLA method;

FIGS. 9A and 9B show waveforms in a drive using an MLA method according to the present invention; and FIG. 10 shows an occurrence pattern of the 4-frame pulse width modulation pattern on a screen for every two rows.

DETAILED DESCRIPTION OF THE PREFERRED EMBODIMENTS

First, discussion will be made on the case where in a simple matrix liquid crystal display panel which is driven by a voltage averaging method or an SA method, one selection time is divided into four equal times, and a gray scale data is represented by four frames. FIG. 5 shows a 4-frame pulse width modulation pattern. In FIG. 5, "0" indicates that a display data is OFF and "1" indicates that the display data is ON. For example, when a gray scale level is 2, all the display data become ON during a selection time of a frame "a". In addition, the display data become ON in pulse widths of 0 and 1 corresponding to a half selection time of a frame "b" and the display data become OFF in pulse widths of 3 and 4. Further, all the display data become OFF in the cases of frames "c" and "d".

Here, for simple description, assume that the entire displayed data is a data in which a half tone level is 2. FIG. 6 shows an occurrence pattern of a 4-frame pulse width modulation pattern on a screen according to the present invention. In a frame "0", a modulation pattern of "a" is used for a combination of an odd column and an odd row; "b" is used for a combination of an even column and an odd row; "c" is used for a combination of an odd column and an even row; and "d" is used for a combination of an even column and an even row. In a next frame "1", the modulation pattern of "c" is used for the combination of the odd column and the odd row; "d" is used for the combination of the even column and the odd row; "a" is used for the combination of the odd column and the even row; and "b" is used for the combination of the even column and the even row. Similarly, frames 2 and 3 are displayed by changing the modulation pattern for every dot.

In the respective dots, the modulation patterns of "a" to "d" are produced for 4 frames, thereby displaying respective gray scale levels. At this time, the modulation patterns of "a" to "d" are produced in 4 dots of 2×2. Thus, the brightness of the entire screen is uniform in the respective frames so that a flicker can be reduced. With this, the number of frames can be increased to 4 or more so that the consumption power can be further reduced.

Figure 7A:
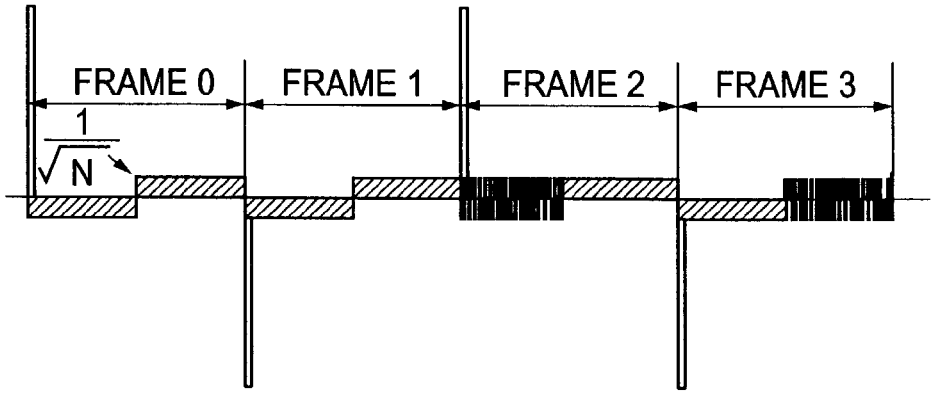
FIGS. 7A and 7B show waveforms in a drive using a voltage averaging method or an SA method according to the present invention.
Figure 7B:
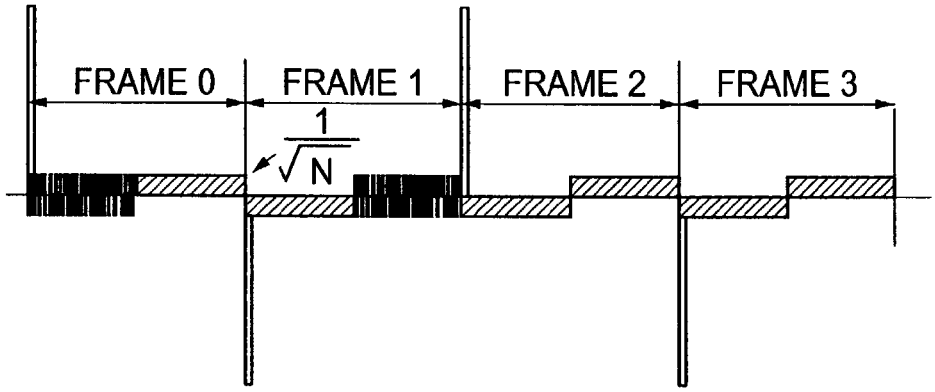

FIGS. 7A and 7B show column electrode waveforms in the case where odd rows and even rows are separately scanned using the 4-frame pulse width modulation pattern shown in FIG. 5 according to the present invention and the occurrence pattern of the 4-frame pulse width modulation pattern on the screen as shown in FIG. 6. When interlaced scanning is conducted for only the odd rows during the first half of the frame "0", all the column electrode waveforms of the odd columns become ON and the number of changes during the scanning is 1. With respect to the even columns, the number of changes is N through a round trip. Next, when interlaced scanning is conducted for only the even rows during the second half of the frame "0", both the odd columns and the even columns become OFF waveforms and the number of changes in column electrode waveform is 1. Similarly, with respect to the case of the odd columns, the number of changes is 1 during the first half of the frame "1", and it is 1 during the second half thereof. In addition, the number of changes is N during the first half of the frame "2", and it is 1 during the second half thereof. The number of changes is 1 during the first half of the frame "3", and it is N during the second half thereof. With respect to the case of the even columns, the number of changes is 1 during the first half of the frame "1", and it is N during the second half thereof. In addition, the number of changes is 1 during the first half of the frame "2" and it is 1 during the second half thereof. The number of changes is 1 during the first half of the frame "3", and it is 1 during the second half thereof.

Therefore, the number of changes in column electrode waveform becomes 2N+6 in total of 4 frames, and it becomes (½)×(2N+6) per frame. The number of changes becomes about ¼ times of 2N in column electrode waveform by the pulse width modulation described in the conventional example. In addition, in this embodiment, the column electrode waveform in which a half tone level is 2, is produced on the entire screen. However, with respect to a general display data, there is no case where a gray scale level is frequently and greatly changed. Thus, similarly, it is needless to say that there is an effect for the reduction in the consumption power.

Next, discussion will be made of the case where in a simple matrix liquid crystal display panel, which is driven by a distributed 4 MLA method, one selection time is divided into four, and a gray scale data is represented by four frames. The 4-frame pulse width modulation pattern, which is shown in FIG. 5 and indicated by a voltage averaging method or an SA method, and the occurrence pattern shown in FIG. 6. are used.

For simple description, assume that the entire displayed data is a data in which a half tone level is 2, and a function as shown in FIG. 8 is used as an orthogonal function. FIGS. 9A and 9B show column electrode waveforms in the case where the 4-frame pulse width modulation pattern shown in FIG. 5 according to the present invention and the occurrence pattern shown in FIG. 6 are used. When only odd rows are selected for every four rows during the first half of a subframe of the frame "0" and scanning is conducted, all the column electrode waveforms of the odd columns become ON and the number of changes during one frame is 4. With respect to the even columns, the number of changes is N through a round trip. Next, when interlaced scanning is conducted for only the even rows during the second half of the subframe of the frame "0", both the odd columns and the even columns become OFF waveforms and the number of changes in column electrode waveform is 4. Similarly, with respect to the case of the odd columns, the number of changes is 4 during the first half of the frame "1" and it is 4 during the second half thereof. In addition, the number of changes is N during the first half of the frame "2" and it is 4 during the second half thereof. The number of changes is 4 during the first half of the frame "3" and it is N during the second half thereof. With respect to the case of the even columns, the number of changes is 4 during the first half of the frame "1" and it is N during the second half thereof. In addition, the number of changes is 4 during the, first half of the frame "2" and it is 4 during the second half thereof. The number of changes is 4 during the first half of the frame "3" and it is 4 during the second half thereof.

Therefore, the number of changes in column electrode waveform becomes 2N+24 in total of 4 frames and it becomes (½)×(2N+24) per frame. The number of changes becomes about ¼ times of 2N in column electrode waveform by the pulse width modulation described in the conventional example. In addition, in this embodiment, the column electrode waveform in which a half tone level is 2 is produced on the entire screen. However, with respect to a general display data, there is no case where a gray scale level is frequently and greatly changed. Thus, similarly, it is needless to say that there is an effect for the reduction in the consumption power.

A gist of the present invention resides in that, even in the case where the 4-frame pulse width modulation pattern is changed in a row direction, the column electrode waveform is changed only one time through a round trip in any gray scale level during several frames required for representing a gray scale. Thus, the present invention is not limited to the driving method, the number of frames required for representing the gray scale, and the number of periods obtained by dividing the selection time described in the above-mentioned embodiment.

Employment of the above gray scale driving method of the present invention enables the number of frames required for representing the gray scale to be increased without causing a flicker, thereby being capable of further reducing the consumption power.

FIG. 10 shows an example in which an occurrence pattern of the 4-frame pulse width modulation pattern on a screen is indicated. As described above, it is considered to be most preferable that the 4-frame pulse width modulation pattern is changed for every row in the row direction. However, even when the 4-frame pulse width modulation pattern is changed for every two rows or more, and the interlaced scanning is conducted for every two rows or more as shown in FIG. 10, the same effect can be obtained.

Next, an example of a liquid crystal display panel driving device using the MLA method to which the present invention is applied will be described with reference to FIG. 1. That is, the liquid crystal display panel driving device using the MLA method as shown in FIG. 1 includes a simple matrix liquid crystal display panel 1 of N rows×M columns, a perpendicular driver 2 for applying row voltages to a row electrode group of N rows in the liquid crystal display panel 1, a horizontal driver 3 for applying column voltages to a column electrode group of M columns in the liquid crystal display panel 1, and a voltage level circuit 4 for supplying voltages of necessary levels to the perpendicular driver 2 and the horizontal driver 3.

Figure 1:
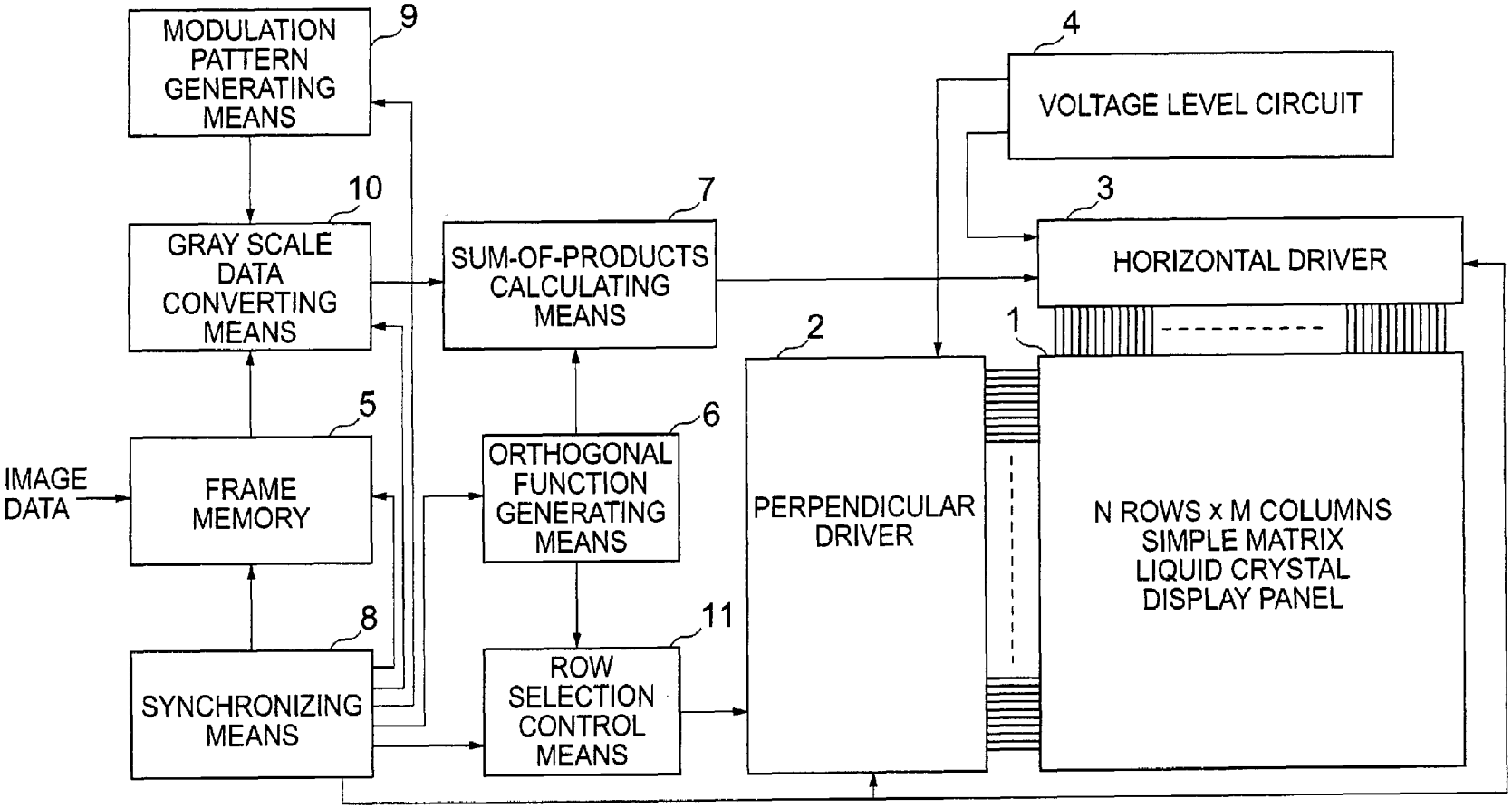
FIG. 1 is a block diagram of a simple matrix liquid crystal display panel driving device constructed by applying a liquid crystal display panel driving method of the present invention thereto.
Figure 2:
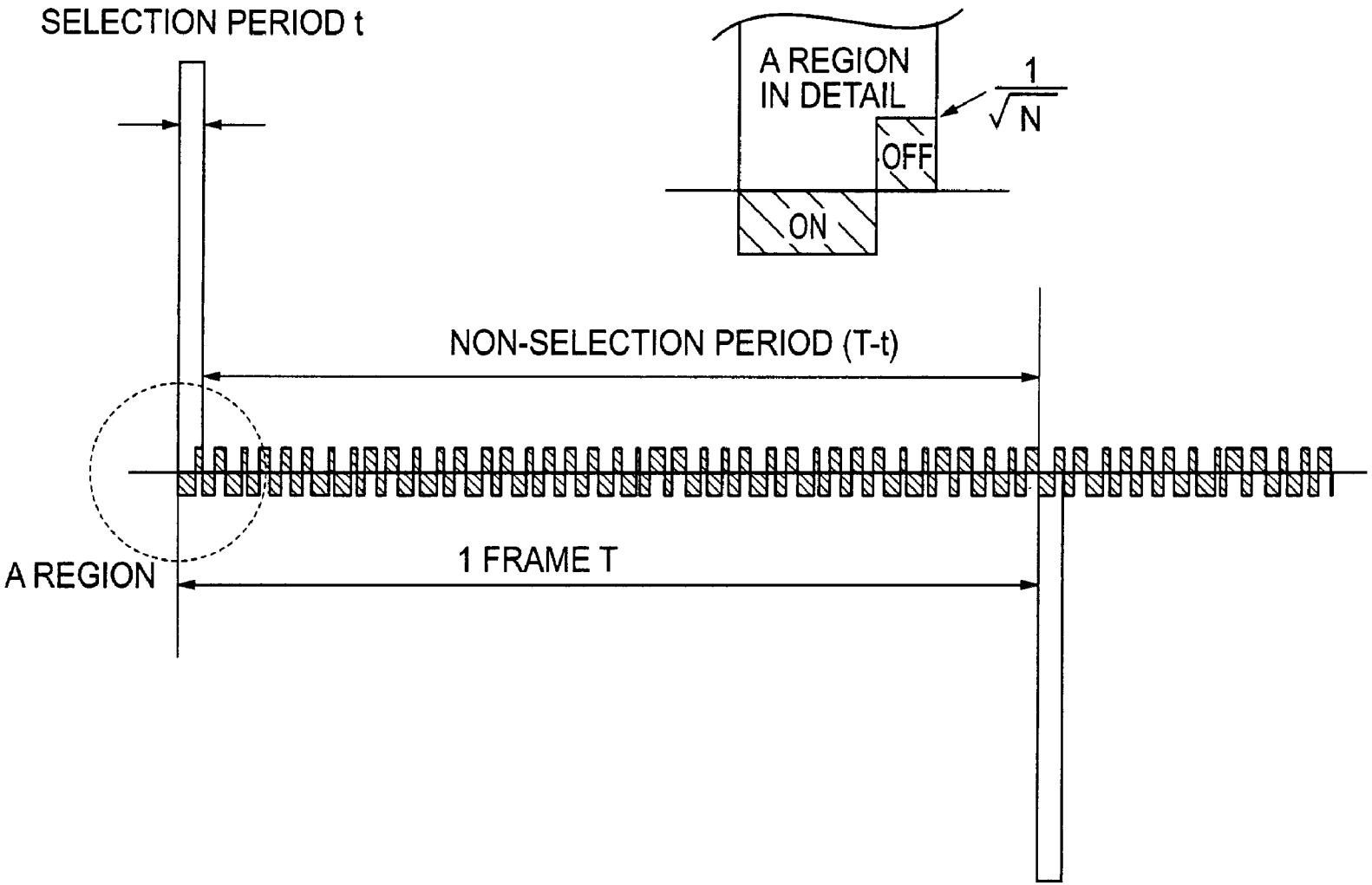
FIG. 2 shows an example of a column electrode waveform in a pulse width modulation method.
Figure 4A:
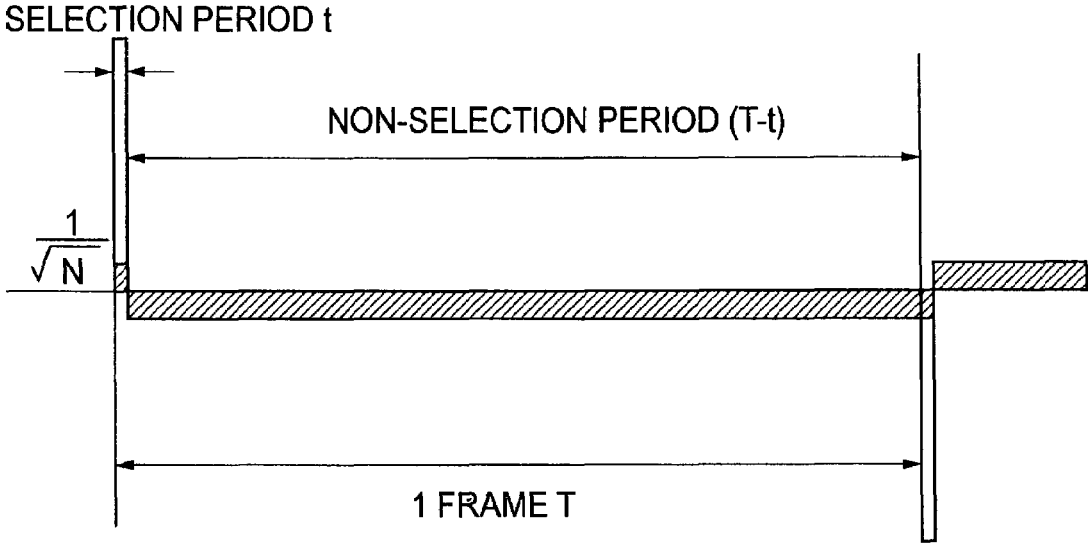
FIGS. 4A and 4B show examples of waveforms in a conventional drive using a voltage averaging method or an SA method.
Figure 4B:
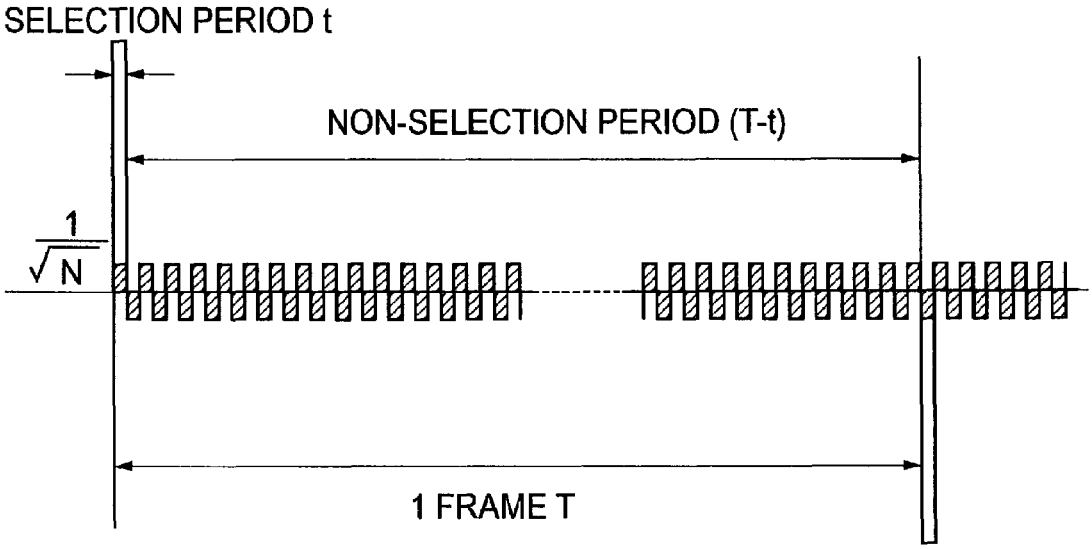

Also, the liquid crystal display panel driving device using the MLA method as shown in FIG. 1 includes a frame memory 5 for storing an image data composed of plural bits in units of frame, an orthogonal function generating means 6 for generating plural orthogonal functions in which there is an orthogonal relationship among them and providing a pattern obtained by a suitable combination thereof in succession to the perpendicular driver 2 through a row selection control means 11, a modulation pattern generating means 9 for generating a modulation pattern used in row selection, a gray scale data converting means 10 for converting the image data stored in the frame memory 5 into the modulation pattern, and a sum-of-products calculating means 7 for conducting sum-of-products calculation between a set of converted image data and a set of orthogonal functions, generating a column signal corresponding to each bit digit, and providing it to the horizontal driver 3.

The above row selection control means 11 is a means for controlling the perpendicular driver 2 so as to simultaneously select four row electrodes in accordance with the orthogonal functions. Note that an orthogonal function table used for the liquid crystal display panel driving device using the 4 MLA method is a table as shown in FIG. 8.

Further, the liquid crystal display panel driving device includes a synchronizing means 8 for synchronizing among timings of various operations.

Note that, although not shown, a liquid crystal display panel driving device using a voltage averaging method or an SA method to which the present invention is applied can be easily constructed as in the case of the above-mentioned liquid crystal display panel driving device using the MLA method.

As described above in detail, according to the liquid crystal display panel driving method of the present invention using the plural frames pulse modulation method, display can be made without causing image degradation such as a flicker even in the case of multi gray scale display in which the number of colors exceeds 4096, as compared with the conventional liquid crystal display panel driving method using the frame modulation method.

Also, the number of changes in voltage waveform on the column electrode becomes extremely smaller than that in the pulse width modulation method. With respect to row electrodes, a voltage is high. However, selection is conducted only one time during one frame and a capacity of a connected panel is required for only selected electrodes. In contract to this, with respect to the column electrodes, a voltage is low. However, voltage waveforms on the respective electrodes are changed according to display data. Thus, it is necessary to change potentials on the entire screen. Accordingly, the consumption power becomes extremely smaller than that in the pulse width modulation method.

Note that the display pattern of this embodiment is displayed with the same half tone gray scale level on the entire screen. When another display pattern is displayed, the column electrode waveform is changed only one time through a round trip in any gray scale level during several frames required for representing the gray scale so that it is needless to say that the present invention can be applied thereto as a matter of course.

According to the liquid crystal display panel driving method of the present invention, even when the number of gray scales is increased, the number of frames required for representing the gray scale can be increased without degrading a display quality, and causing a flicker, whereby being capable of further reducing the consumption power.

What is claimed is:

1. A liquid crystal display panel driving method of driving a liquid crystal display panel in which a liquid crystal layer is held between a row electrode group and a column electrode group to provide pixels in matrix in accordance with a given image data, the method comprising:

performing pulse width modulation with a sum total of a plurality of pulses selected in a plurality of frames, wherein an occurrence order of the plurality frames in an odd row into which a pattern of the pulse width modulation is divided is different from that in an even row.

2. A liquid crystal display panel driving method according to claim 1, wherein the odd row and the even row are separately scanned.

3. A liquid crystal display panel driving method according to claim 2; wherein the driving method of driving the liquid crystal display panel in which the liquid crystal layer is held between the row electrode group and the column electrode group to provide the pixels in matrix in accordance with the given image data is one selected from the group consisting of a voltage averaging method, an SA method, and an MLA method.

4. A liquid crystal display panel driving method according to claim 1; wherein the driving method of driving the liquid crystal display panel in which the liquid crystal layer is held between the row electrode group and the column electrode group to provide the pixels in matrix in accordance with the given image data is one selected from the group consisting of a voltage averaging method, an SA method, and an MLA method.

* * * * *